US006811415B2

(12) United States Patent
Chen

(10) Patent No.: US 6,811,415 B2
(45) Date of Patent: Nov. 2, 2004

(54) CONNECTOR PROTECTING DEVICE

(75) Inventor: Yun-Lung Chen, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/339,516

(22) Filed: Jan. 8, 2003

(65) Prior Publication Data

US 2003/0220002 A1 Nov. 27, 2003

(30) Foreign Application Priority Data

May 24, 2002 (TW) ..... 91207531 U

(51) Int. Cl.[7] ..... H01R 13/44
(52) U.S. Cl. ..... 439/133; 439/373
(58) Field of Search ..... 439/133, 135, 439/367, 373, 304, 371; 174/67

(56) References Cited

U.S. PATENT DOCUMENTS 4,603,931 A * 8/1986 Ruffman ..... 439/133
4,674,813 A * 6/1987 Feldner ..... 439/133

* cited by examiner

*Primary Examiner*—Ross Gushi
(74) *Attorney, Agent, or Firm*—Wei Te Chung

(57) ABSTRACT

A connector protecting device for retaining connectors (40) on electronic devices includes a rear plate (10), a receptacle (20) for accomodating connectors, a cover (30) and a locking device (50). The receptacle extending from the rear plate includes a top wall (21), a bottom wall (23) and two side walls (22). The top wall extends a first fixing portion (24) with a hole (25) and the bottom wall froms a pair of slideways (27). The cover includes a base (32), a panel (31) extending upwardly from the base and a second fixing portion (33) with a hole (34) extending from the top edge of the panel. The base of the cover can slide into the slideways of the receptacle. The hole in the first fixing portion of the receptacle is aligned with the hole in the second fixing portion of the cover and the locking device locks the cover to the receptacle.

14 Claims, 5 Drawing Sheets

CONNECTOR PROTECTING DEVICE

BACKGROUND OF THE INVENTION

1. Field of the Invention

The present invention relates to protecting devices, and particularly to a protecting device for electrical connectors. The invention relates to a copending application Ser. No. 10/172,078 filed Jun. 14, 2002, and a U.S. Pat. No. 6,485,316 both having the same inventor and the same assignee with the invention.

2. Related Art

Various large scale electrical connectors are installed in computers for electronic communication and handling of data. Screws are often used to fix and secure such connectors to corresponding parts of the computers.

A typical large scale connector is usually fixed on an input/output (I/O) interface of a computer by two setscrews. The connector forms two additional parts at opposite sides thereof to receive the respective setscrews. The I/O interface forms a corresponding base and defines screw holes. This configuration adds to the bulk of the connector, and runs against the modern trend toward miniaturization of computers. In addition, using screws to mount connectors to an I/O interface is unduly laborious and time-consuming. This is particularly manifest in mass production facilities, where extra time spent is translated into higher costs.

In contrast, a typical small scale connector such as a universal serial bus (USB) connector or keyboard connector is directly inserted into an I/O interface of an electronic device. No other means are used to fix the connector. If cables of the connector or the connector itself are accidentally bumped or pulled, the connector is liable to disengage from the I/O interface and cause disruption of transmission of data.

In the case of both large and small scale connectors, there is no protection from unauthorized users detaching the connector from the I/O interface.

SUMMARY OF THE INVENTION

Accordingly, an object of the present invention is to provide a connector protecting device which readily and securely retains connectors to an electronic device.

To achieve the above-mentioned object, a connector protecting device is provided for securely retaining connectors at outside interfaces of electronic devices. The connector protecting device comprises a rear plate, a receptacle for accomodating connectors, a cover and a locking device. The rear plate defines an opening. The receptacle extending from the rear plate around edges of the opening comprises a top wall, a bottom wall and two side walls, the top wall extends a first fixing portion with a hole and the bottom wall froms a pair of slideways. The cover comprises a base, a panel extending perpendicularly from the base and a second fixing portion with a hole extending from the top edge of the panel. Wherein the base of the cover can slide into the slideways of the receptacle. The hole in the first fixing portion of the receptacle is aligned with the hole in the second fixing portion of the cover and the locking device locks the cover to the receptacle.

Other objects, advantages and novel features of the present invention will be drawn from the following detailed description of preferred embodiments of the present invention with the attached drawings, in which:

DESCRIPTION OF THE PREFERRED EMBODIMENTS

Figure 1:
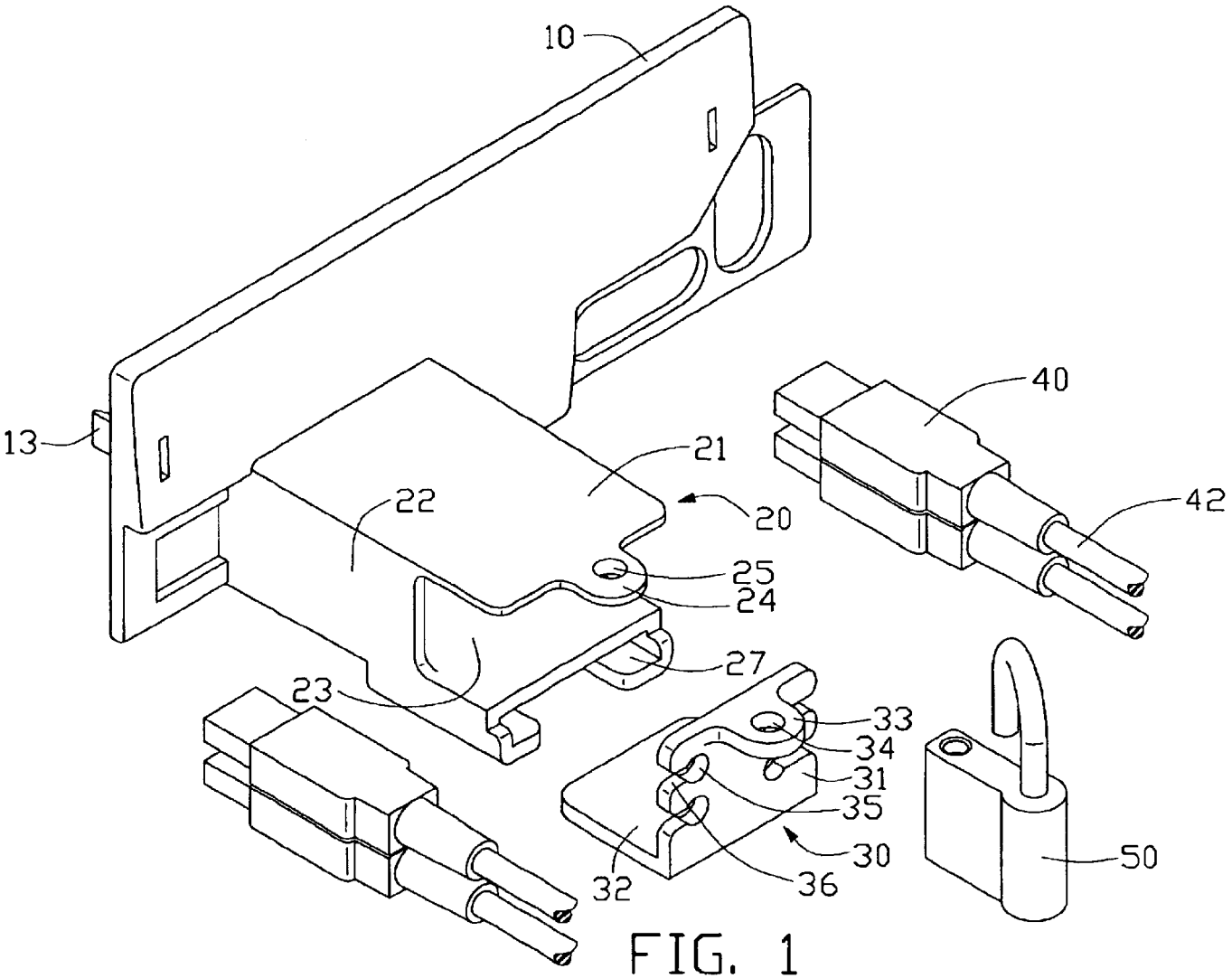
FIG. 1 is an exploded, isometric view of a connector protecting device in accordance with a preferred embodiment of the present invention, together with four connectors and a locking device.
Figure 2:
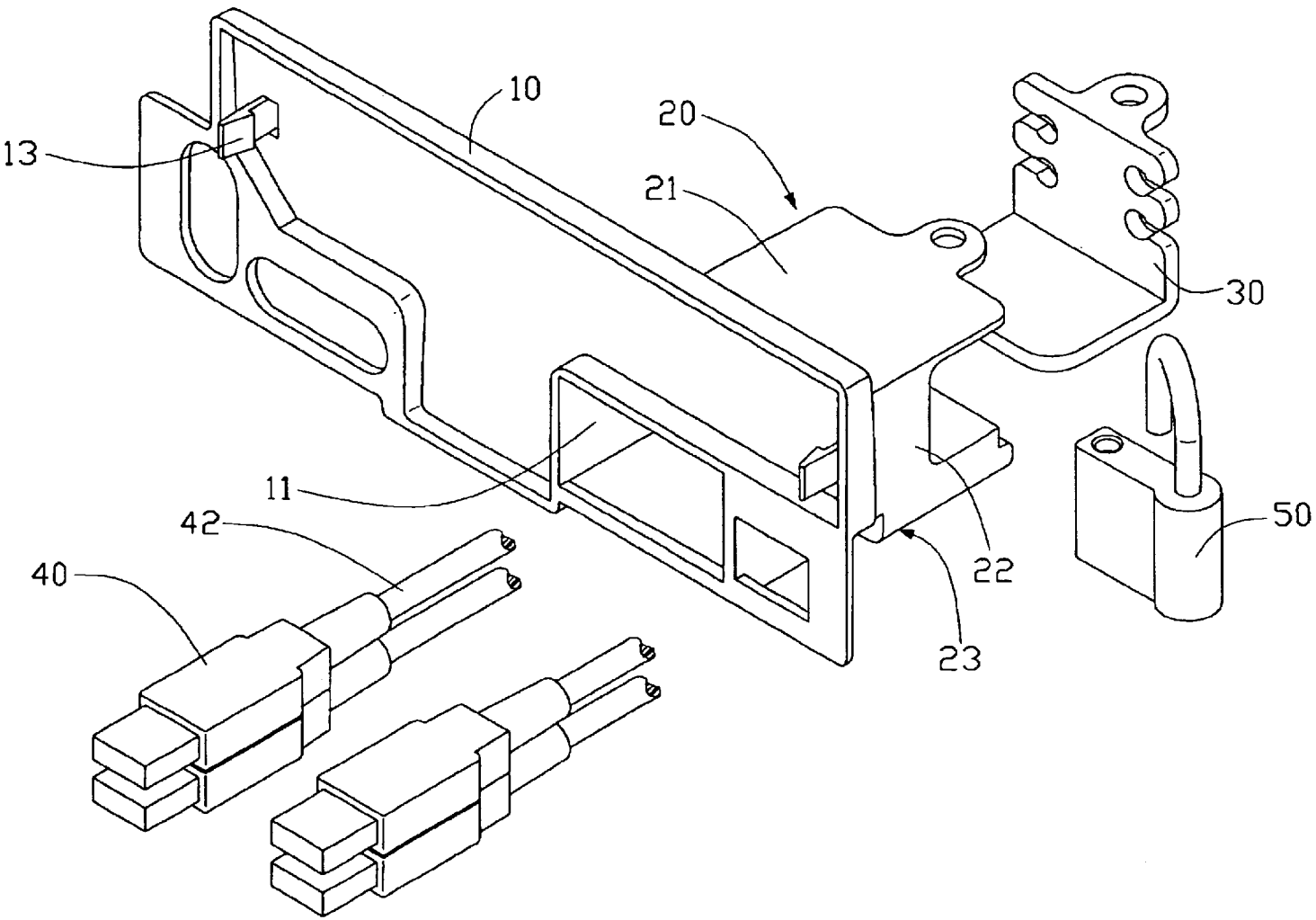
FIG. 2 is similar to FIG. 1, but viewed from another aspect.
Figure 3:
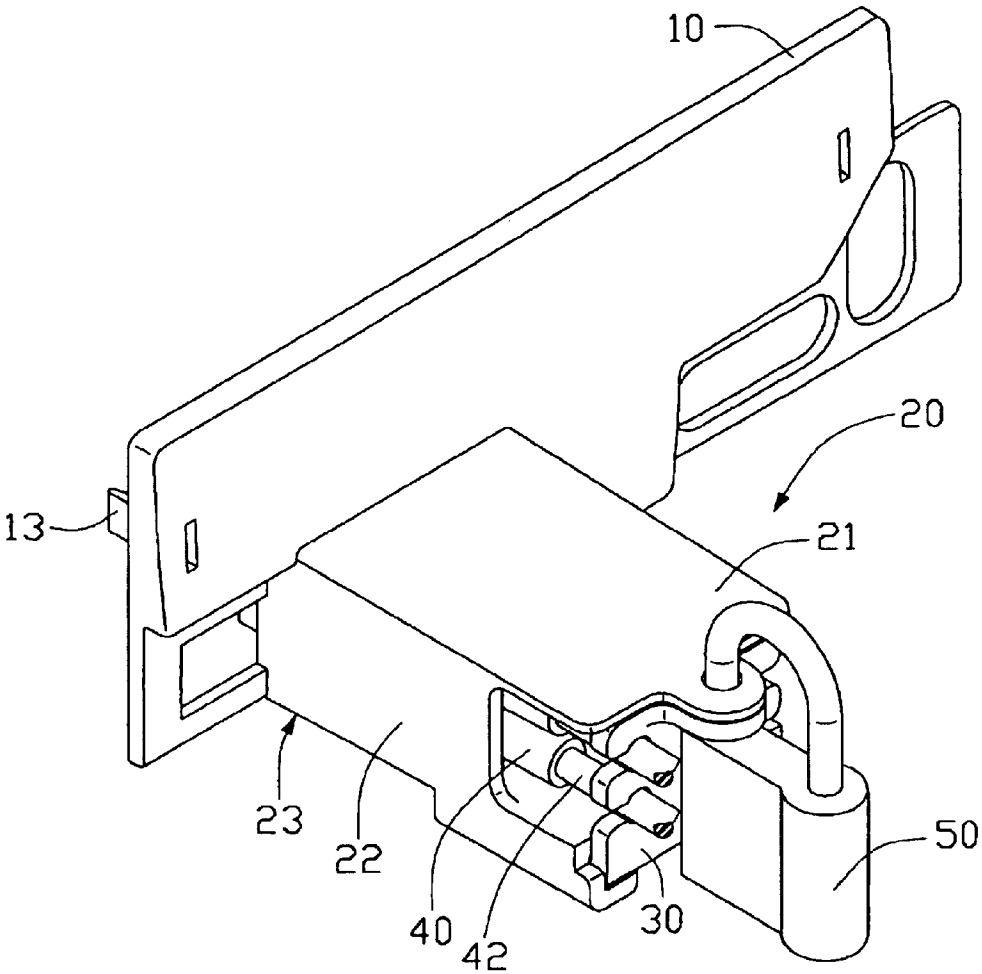
FIG. 3 is an assembled view of FIG. 1.

Referring to FIGS. 1–3, a connector protecting device in accordance with a preferred embodiment of the present invention is used for protecting connectors 40 such as USB connectors. The connector protecting device comprises a rear plate 10, a receptacle 20, and a cover 30.

The rear plate 10 defines a rectangular opening 11. A pair of spaced latchs 13 extends rearwardly from the rear plate 10, for attaching the rear plate 10 to an electronic device.

The retainer 20 extends forwardly from the rear plate 10. The retainer 20 comprises a top wall 21, a bottom wall 23 and two side walls 22 extending perpendicularly from the rear plate 10 at the opening 11. The side walls 22 are shorter than the top and bottom walls 21, 23. The side, top and bottom walls 22, 21, 23 thus cooperatively define a cutout (not labeled) therebetween. The top wall 21 has a narrowed first fixing portion 24 at a distal end thereof. A hole 25 is defined in the first fixing portion 24. The bottom wall 23 integrally forms a pair of slideways 27 extending from opposite side edges thereof respectively. Each slideway 27 is disposed below the bottom wall 23, and has an L-shaped profile.

The cover 30 comprises a base 32, a panel 31 extending perpendicularly upwardly from a front end of the base 32, and a second fixing portion 33 extending forwardly from a top end of the panel 31. The second fixing portion 33 is parallel to the base 32. A pair of guiding slots 36 and adjoining apertures 35 is defined in each of opposite side edges of the panel 31. The guiding slots 36 guide cables 42 of the connectors 40 to be retained in the apertures 35. A hole 34 is defined in the second fixing portion 33.

In the connector proctecting device of the present invention, the receptacle 20 can receive a plurality of connectors. In the preferred embodiment of the present invention, four connectors 40 are shown and described as an illustrative example only. In assembly, the four connectors 40 are passed through the cutout of the receptacle 20 until they protrude out from the receptacle 20 through the opening 11. The connectors 40 are connected with corresponding interfaces of the electronic device. The rear plate 10 is slid rearwardly over the connectors 40 until the latchs 13 snappingly engage with the electronic device. In this position, the connectors 40 are fully received in the receptacle 20. The cables 42 of the connectors 40 are pressed into corresponding apertures 35 through the adjoining guiding slots 36 of the cover 30. The cover 30 slid rearwardly along the cables 42, and the base 32 of the cover 30 slides into the slideways 27. The cover 30 is thus slid until the panel 31 abuts a front edge of the bottom wall 23 of the receptacle 20. The hole 34 of the second fixing portion 33 of the cover 30 is aligned with the hole 25 of the first fixing portion 24 of the top wall 21. A locking device 50 extends through the holes 25, 34 to lock the cover 30 to the receptacle 20.

In the connector protecting device of the present invention, the connectors 40 received in the receptacle 20 are blocked by the cover 30 from moving forwardly. The connectors 40 are thus protected from being accidentally pulled away from the interwalls of the electronic device. Furthermore, the locking device 50 secures the connectors 40 in the receptacle 20. Only authorized persons can detach the cover 30 and disconnect the connectors 40.

Figure 4:
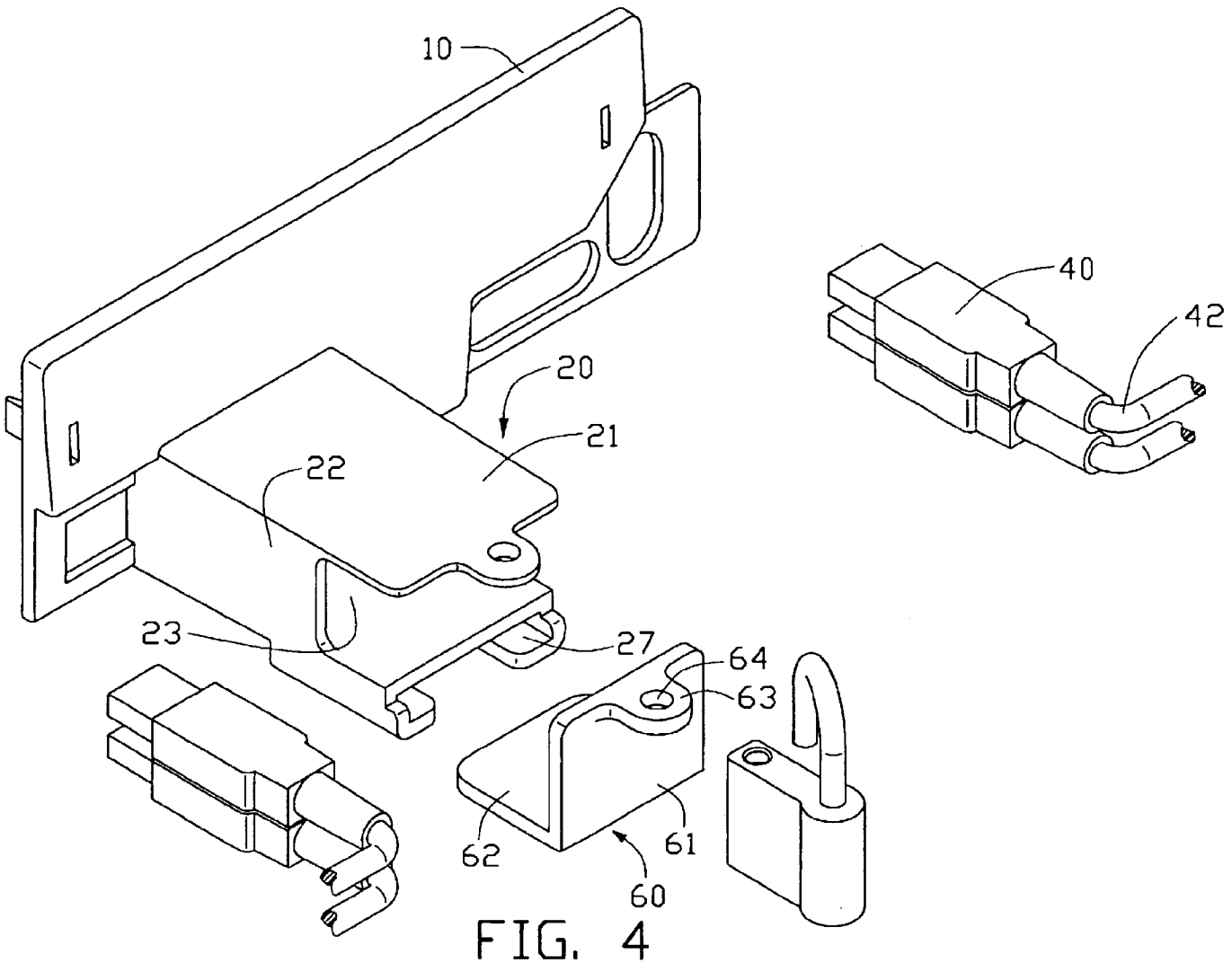
FIG. 4 is an exploded, isometric view of a connector proctecting device in accordance with an alternative embodiment of the present invention, together with the four connectors and the locking device of FIG. 1.
Figure 5:
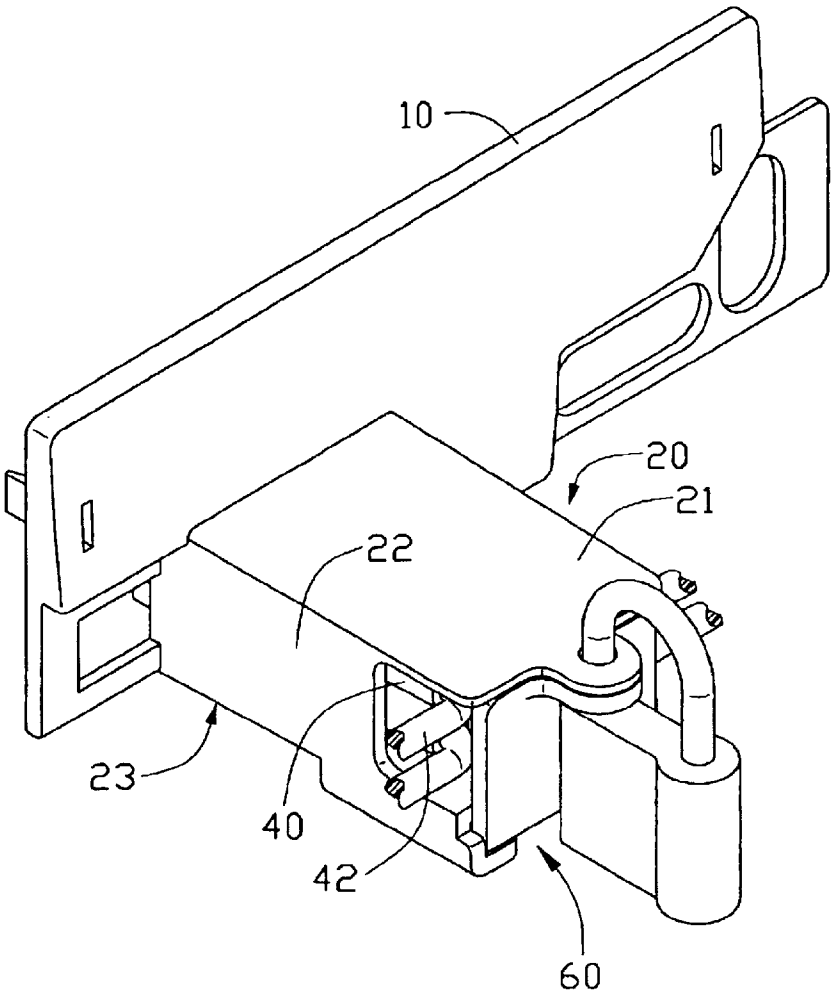
FIG. 5 is an assembled view of FIG. 4.

FIGS. 4–5 show a connector protecting device in accordance with an alternative embodiment of the present invention. The connector protecting device comprises a rear plate 10, a receptacle 20, and a cover 60. The rear plate 10 and the receptacle 20 are substantially the same as those of the above-described preferred embodiment. The cover 60 comprises a base 62, a panel 61 extending perpendicularly upwardly from a front end of the base 62, and a second fixing portion 63 extending forwardly from a top end of the panel 61. The second fixing portion 63 is parallel to the base 62. A hole 64 is defined in the second fixing portion 63. In assembly, the cables 42 of the connectors 40 pass through respective opposite portions of the cutout (not labeled) of the receptacle 20. The base 62 of the cover 60 is slid rearwardly into the slideways 27 of the receptacle 20. The panel 61 of the cover 60 abuts a front edge of the bottom wall 23 of the receptacle 20. The hole 64 of the second fixing portion 63 is aligned with the hole 25 of the first fixing portion 24. The locking device 50 locks the cover 60 to the receptacle 20.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector protecting device for retaining a connector to an electronic device, comprising:

a plate defining an opening for access of the connectors;

a receptacle for accommodating the connector therein, the receptacle extending from the plate and in communication with the opening and forming a pair of slideways underneath thereof;

a cover sliding along the slideways, detachably attached to the receptacle; and means for locking the cover and the receptacle thereby retaining the connectors in the receptacle and keeping the connectors in electrically contact with the electronic device.

2. The connector protecting device as claimed in claim 1, wherein the plate forms a pair of barbs for mounting the plate to the electric device.

3. The connector protecting device as claimed in claim 1, wherein the receptacle comprises a top wall, a bottom wall and two side walls.

4. The connector protecting device as claimed in claim 3, wherein the locking means comprises a first fixing portion extending from the top wall of the receptacle, a second fixing portion formed on the cover, and a lock for locking the first and second fixing portions together.

5. The connector protecting device as claimed in claim 3, wherein the bottom wall of the receptacle forms the pair of slideways for sliding of the cover therein.

6. The connector protecting device as claimed in claim 3, wherein the top wall and the bottom wall of the receptacle are longer than the two side walls thereby forming a cutout in a free end of each side wall.

7. The connector protecting device as claimed in claim 5, wherein the slideways are L-shaped extending from opposite edges of the bottom wall of the receptacle.

8. The connector protecting device as claimed in claim 5, wherein the cover comprises a base slidably received in the slideways, and a panel extending perpendicularly from the base.

9. The connector protecting device as claimed in claim 8, wherein the panel defines a plurality of apertures for access of cables of connectors.

10. The connector protecting device as claimed in claim 1, wherein the cover defines a plurality of apertures for access of cables of connectors and defines a plurality of guiding slots communicating with the apertures respectively, through which cables of the connectors can access to the apertures.

11. A connector protecting device assembly comprising:

a plate defining an opening along a front-to-back direction thereof;

a receptacle extending rearwardly from a back plane of the plate and in communication with said opening, and forming a pair of slideways underneath thereof;

a cover sliding along the slideways, detachably secured to the receptacle and covering said receptacle along said front-to-back direction;

a plurality of connectors disposed in said receptacle; and a lock securing said cover and said receptacle together.

12. The assembly as claimed in claim 11, wherein said cover is movable relative to the receptacle along said front-to-back direction when said lock is removed.

13. The assembly as claimed in claim 11, wherein said cover defines a plurality of cutouts, and a plurality of cables respectively extend rearwardly from the corresponding connectors through said cutouts.

14. The assembly as claimed in claim 11, wherein space is formed between the receptacle and the cover to allow a plurality of cables extending from the corresponding connectors to extend therethrough laterally.

* * * * *